US008058331B2

(12) United States Patent
Rajagopalan et al.

(10) Patent No.: US 8,058,331 B2
(45) Date of Patent: Nov. 15, 2011

(54) GOLF BALLS CONTAINING HIGHLY NEUTRALIZED ACID POLYMERS AND SUGAR ESTER HLB MODIFIERS

(75) Inventors: Murali Rajagopalan, South Dartmouth, MA (US); Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 314 days.

(21) Appl. No.: 12/407,920

(22) Filed: Mar. 20, 2009

(65) Prior Publication Data

US 2010/0240468 A1 Sep. 23, 2010

(51) Int. Cl.

| | |
|---|---|
| ***A63B 37/12*** | (2006.01) |
| ***A63B 37/00*** | (2006.01) |
| ***C08L 33/02*** | (2006.01) |
| ***C08K 5/1535*** | (2006.01) |
| ***C08K 5/1545*** | (2006.01) |

(52) U.S. Cl. ..... 524/110; 524/111; 524/308; 524/310; 524/317; 473/372; 473/373; 473/378; 473/385

(58) Field of Classification Search ..... None
See application file for complete search history.

(56) References Cited

U.S. PATENT DOCUMENTS

| | | | | |
|---|---|---|---|---|
| 5,019,320 | A | 5/1991 | Hasegawa et al. | |
| 6,329,458 | B1 | 12/2001 | Takesue et al. | |
| 6,417,282 | B2 | 7/2002 | Takesue et al. | |
| 6,624,221 | B2 | 9/2003 | Takesue et al. | |
| 7,091,264 | B2 | 8/2006 | Graves | |
| 7,365,128 | B2 | 4/2008 | Sullivan | |
| 2002/0013421 | A1 * | 1/2002 | Takesue et al. | 525/418 |
| 2002/0099120 | A1 * | 7/2002 | Takesue et al. | 524/394 |
| 2002/0107313 | A1 * | 8/2002 | Hausmann et al. | 524/308 |
| 2005/0256269 | A1 * | 11/2005 | Takesue et al. | 525/221 |
| 2007/0049673 | A1 * | 3/2007 | Sullivan | 524/386 |

FOREIGN PATENT DOCUMENTS

JP 2001161179 * 6/2001

* cited by examiner

*Primary Examiner* — David Buttner
(74) *Attorney, Agent, or Firm* — William B. Lacy

(57) ABSTRACT

A golf ball comprising a core and a cover layer surrounding the core, where at least one of the core and the cover layer includes a polymer composition of a highly neutralized acid polymer and a sugar ester HLB modifier such that the sugar ester HLB modifier is present from about 15 wt % to about 40 wt % of the polymer composition.

16 Claims, No Drawings

GOLF BALLS CONTAINING HIGHLY NEUTRALIZED ACID POLYMERS AND SUGAR ESTER HLB MODIFIERS

FIELD OF THE INVENTION

This invention relates to polymer compositions including highly neutralized polymers and sugar esters as HLB modifiers for use in golf balls.

BACKGROUND OF THE INVENTION

Conventional golf balls designs include solid and wound configurations, with the majority being of solid construction. Solid golf balls can include one-piece, two-piece (i.e., solid core and a cover), and multi-layer (i.e., solid core of one or more layers and/or a cover of one or more layers) golf balls. Wound golf balls typically include a solid, hollow, or fluid-filled center, surrounded by a tensioned elastomeric material, and a cover.

Golf ball core and cover layers are typically constructed with polymer compositions including, for example, polybutadiene rubber, polyurethanes, polyamides, ionomers, and blends thereof. Ionomers, particularly ethylene-based ionomers, have become a common choice of polymers for golf ball layers because of their toughness, durability, and wide range of hardness values.

Ionomers can be stiffened by increasing the amount of neutralization. Neutralization to 70% and higher, including 100%, has been disclosed. However, in the absence of flow additives, at neutralization levels above about 60%, the melt flow of the ionomer is decreased to an extent such that processability decreases or disappears altogether. For trivalent cations, the percent neutralization at which the polymer becomes unprocessable, in the absence of flow additives, can be significantly lower. Frequently, flow additives can include fatty acids or their salts.

Although improvements in processability and golf ball properties have been achieved, the options for flow additives is limited and usually come with compromises such as discoloration, surface blooming and coating adhesion to name a few. Therefore, new polymer compositions and components continue to be sought for use in forming golf balls.

SUMMARY OF THE INVENTION

In light of the problems and deficiencies noted above, the present invention provides a golf ball having a core and a cover layer surrounding the core. At least one of the core and the cover layer includes a polymer composition of a highly neutralized acid polymer and a sugar ester HLB modifier. The sugar ester HLB modifier can be present from about 15 wt % to about 40 wt % of the polymer composition.

The present invention is directed to a golf ball including a core and a cover layer surrounding the core, wherein at least one of the core or the cover layer comprises a polymer composition of a highly neutralized acid polymer and a sugar ester HLB modifier such that the sugar ester HLB modifier is present from about 15 wt % to about 40 wt % of the polymer composition.

In one embodiment, the highly neutralized acid polymer is a copolymer of a $C_3$ to $C_8$ $\alpha,\beta$-ethylenically unsaturated carboxylic acid and a $C_2$ to $C_6$ $\alpha$-olefin. The highly neutralized acid polymer may further include a softening monomer. Preferably, the highly neutralized acid polymer is at least 95% neutralized, more preferably 100%. In a preferred embodiment, the highly neutralized acid polymer is neutralized with a metal cation and a fatty acid or fatty acid salt present in amounts sufficient to neutralize the acid polymer by 100%.

In another embodiment, the sugar ester HLB modifier is an ester of a fatty acid or salt thereof and a $C_5$ or $C_6$ sugar. Preferably, the fatty acid is selected from the group consisting of stearic acid, lauric acid, palmitic acid, oleic acid, salts thereof, and combinations thereof, and the $C_5$ or $C_6$ sugar is selected from the group consisting of arabinose, ribose, ribulose, xylose, xylulose, lyxose, allose, altrose, fructose, galactose, glucose, gulose, idose, mannitose, sorbitose, talose, tagatose and sedoheptulose, sucrose esters of fatty acids, polyoxyethylene derivatives thereof, and combinations thereof.

Preferably, the $C_5$ or $C_6$ sugar is sorbitose and the ester of the fatty acid is

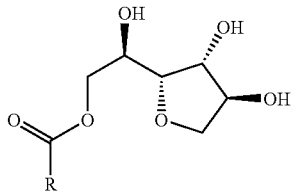

where R is a fatty acid group derived from the fatty acid. The $C_5$ or $C_6$ sugar may also be a polyoxyethylene derivative. The polyoxyethylene is sorbitose and the ester of the fatty acid is preferably

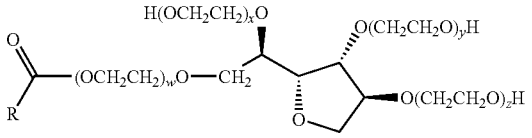

where R is a fatty acid group derived from the fatty acid and w, x, y and z are integers.

In an alternative embodiment, the sugar ester HLB modifier is present from about 20 wt % to about 35 wt % of the polymer composition. Preferably, the sugar ester HLB modifier has a HLB from about 3 to about 35. The polymer composition preferably has a melt flow index from about 0.5 to about 5.0.

The core may be solid or include a center and an outer core layer. Preferably, the outer core layer includes the polymer composition. The cover layer may be a double cover having an inner cover layer and an outer cover layer. The inner cover layer preferably includes the polymer composition. The cover layer can include a thermoplastic or thermoset polyurethane or polyurea.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF EXEMPLARY EMBODIMENTS

The following detailed description of the embodiments of the present invention is not intended to limit the scope of the invention, as claimed, but is presented for purposes of illustration only, and not to necessarily limit features and characteristics of the present invention. Rather, the description is intended to set forth the best mode of operation of the invention, and to sufficiently enable one skilled in the art to practice the invention. Accordingly, the scope of the present invention is to be defined by the appended claims.

In describing and claiming the present invention, the following terminology will be used:

The singular forms "a," "an," and "the" include plural referents unless the context clearly dictates otherwise. Thus, for example, reference to "a layer" includes reference to one or more of such layers.

As used herein with respect to an identified property or circumstance, the term "substantially" refers to a degree of deviation that is sufficiently small so as to not measurably detract from the identified property or circumstance. The exact degree of deviation allowable may in some cases depend on the specific context. For example, "substantially free," as used herein, means that the composition does not contain the cited material in any significant amount.

As used herein, the term "adjacent" refers to the proximity of two structures or elements. Particularly, elements that are identified as being "adjacent" may be either abutting or connected. Such elements may also be near or close to each other without necessarily contacting one another.

As used herein, the term "highly neutralized acid polymer" refers to an acid polymer or copolymer after at least 70%, at least 90%, at least 95%, at least 98%, or 100% of the acid groups thereof are neutralized by a cation source or a fatty acid (or salt thereof) both present in amounts sufficient to provide the desired neutralization. Neutralization can be effected prior to, during, or after combining the acid polymer(s) with the HLB modifier(s). Often, the HLB modifier is combined with an unneutralized or partially neutralized (i.e., less than 70% neutralized) acid polymer, and a cation source is subsequently added to further neutralize the acid polymer to 70% neutralization or higher.

As used herein, the term "HLB" refers to hydrophile-lipophile-balance which is a measure of the balance or proportion of hydrophilic to lipophilic portions of a molecule.

As used herein, the term "copolymer" refers to polymers having at least two types of monomers.

As used herein, the term "(meth)acrylic acid" means methacrylic acid and/or acrylic acid. Likewise, the term "(meth) acrylate" means methacrylate and/or acrylate.

As used herein, the term "softening" means that the crystallinity is disrupted (the polymer is made less crystalline). The degree of softening can vary as long as the decrease in crystallinity is substantial.

As used herein, the term "sugar esters" refer to sugar derivatives which include at least one ester group. Although some sugar esters are commercially available, they can also be formed through reaction of a fatty acid ester and a sugar using a suitable catalyst, e.g. enzymatic and/or acid catalysts.

As used herein, the term "polymer composition" refer to a composition having a highly neutralized acid polymer and a sugar ester HLB modifier.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Other than in the operating examples, or unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

In the present disclosure, any steps recited in any method or process may be executed in any order and are not limited to the order presented.

All patents, publications, test procedures, and other references cited herein, are fully incorporated by reference to the extent such disclosure is not inconsistent with this invention and for all jurisdictions in which such incorporation is permitted.

Golf balls of the present invention can include a variety of constructions. One-piece, two-piece, multi-layer, and wound golf balls having a variety of core structures, intermediate layers, and covers, are all suitable for use in connection with the present invention. Golf ball cores may be a single homogenous layer comprising the entire core from the center of the core to its outer periphery. Alternatively, the core may be a multi-layer core having a center surrounded by at least one outer core layer. The center, innermost portion of such multi-layer cores is most often solid, but may optionally be hollow or filled with a liquid, gel or gas. The outer core layer can be solid. Alternatively, the outer core layer can be a wound layer formed of a tensioned elastomeric material. Golf ball covers of the present invention can also include one or more layers. For example, a double cover can have an inner and outer cover layer. Optionally, additional intermediate layers may be disposed between the core and cover.

Golf balls of the invention can generally include a core and a cover layer surrounding the core. According to the invention, at least one of the core and the cover layer includes a polymer composition of a highly neutralized acid polymer and a sugar ester HLB modifier.

Acid polymers suitable for use in the present invention are generally homopolymers or copolymers of α,β-ethylenically unsaturated mono- or dicarboxylic acids, including combinations thereof. Non-limiting examples of α,β-ethylenically unsaturated mono- or dicarboxylic acids are (meth)acrylic acid, ethacrylic acid, maleic acid, crotonic acid, fumaric acid, itaconic acid. (Meth)acrylic acid particularly provides good results.

One specific class of suitable acid copolymers are copolymers of a $C_3$ to $C_8$ α,β-ethylenically unsaturated mono- or dicarboxylic acid and a $C_2$ to $C_6$ α-olefin, optionally including a softening monomer. Particularly suitable acid polymers are copolymers of ethylene and (meth)acrylic acid which include a softening monomer. When a softening monomer is included, such copolymers are referred to herein as an E/X/Y-type copolymer, where E is ethylene, X is a $C_3$ to $C_8$ α,β-ethylenically unsaturated mono- or dicarboxylic acid, and Y is a softening monomer. The softening monomer is typically an alkyl(meth)acrylate, where the alkyl groups have from 1 to 8 carbon atoms. Although other softening monomers can be suitable, non-limiting examples can include (meth)acrylate, ethyl acrylate, propyl acrylate, butyl acrylate, pentyl acrylate, hexyl acrylate, heptyl acrylate, octyl acrylate, n-butyl(meth)acrylate, isobutyl(meth)acrylate, methyl(meth) acrylate, and ethyl(meth)acrylate. Specific non-limiting examples of E/X/Y-type copolymers are those where X is (meth)acrylic acid and/or Y is selected from (meth)acrylate, n-butyl(meth)acrylate, isobutyl(meth)acrylate, methyl(meth) acrylate, and ethyl(meth)acrylate. Particularly suitable E/X/Y-type copolymers are ethylene/(meth)acrylic acid/n-butyl acrylate, ethylene/(meth)acrylic acid/methyl acrylate, and ethylene/(meth)acrylic acid/ethyl acrylate. In another aspect, the acid polymer can be ethylene-acrylic or (meth)acrylic copolymers or terpolymers (e.g. an alkyl ester such as butyl acrylate).

The amount of ethylene or $C_3$ to $C_6$ α-olefin in the acid copolymer is typically at least 15 wt %, in some cases at least 25 wt %, in other cases at least 40 wt %, and in others at least 60 wt %, based on the total weight of the copolymer. The amount of $C_3$ to $C_8$ α,β-ethylenically unsaturated mono- or dicarboxylic acid in the acid copolymer is typically from 1 wt % to 35 wt %, such as from 5 wt % to 30 wt %, from 5 wt % to 25 wt %, or from 10 wt % to 20 wt %, based on the total weight of the copolymer. If present, the amount of optional softening comonomer in the acid copolymer can be from 1 wt % to 50 wt %, from 5 wt % to 40 wt %, from 10 wt % to 35 wt %, or from 20 wt % to 30 wt %, based on the total weight of the copolymer.

Further examples of suitable acid polymers include SURLYN® ionomers, commercially-available from DuPont; ACLYN® ionomers, commercially-available from Honeywell International Inc.; IOTEK® ionomers, commercially-available from ExxonMobil Chemical Company; CLARIX® ionomers, commercially-available from Schulman, and the acid copolymers described in U.S. Pat. No. 6,953,820, the disclosure of which is hereby incorporated herein by reference.

The acid polymers of the present invention can be direct copolymers where the polymer is polymerized by adding all monomers simultaneously, as described in, for example, U.S. Pat. No. 4,351,931, the disclosure of which is hereby incorporated herein by reference. Ionomers can also be made from direct copolymers, as described in, for example, U.S. Pat. No. 3,264,272, the disclosure of which is hereby incorporated herein by reference. Alternatively, the acid polymers of the present invention can be graft copolymers, wherein a monomer is grafted onto an existing polymer, as described in, for example, U.S. Patent Application Publication No. 2002/0013413, the entire disclosure of which is hereby incorporated herein by reference. Other polymer types can also be prepared, as are known in the art, e.g., block copolymers, random copolymers, etc.

The acid polymers of the invention can be neutralized using any suitable neutralizing agent. The particular choice of neutralizing agent can also affect processability. Typically such neutralizing agents can be metal cations such as alkali metals, transition metals and alkaline earth metals, although other cation sources can be suitable such as organic amine compounds, ammonium, and the like. Non-limiting examples of suitable metal cations can include lithium, sodium, potassium, magnesium, calcium, barium, lead, tin, zinc, aluminum, manganese, nickel, chromium, copper, and mixtures thereof. The amount of cation used can be readily determined based on the desired level of neutralization.

Alternatively, or in addition to a sufficient amount of metal cations, a sufficient amount of an organic acid or salt of organic acid, can be added to the acid copolymer or ionomer as a melt flow modifier or as well as a neutralizing agent as in the case of a salt of organic acid to achieve a higher degree of neutralization. Such organic acids and their salts in the presence of a sufficient amount of a suitable base can also contribute to enhancing resilience of the polymer composition having a highly neutralized acid polymer component. The organic acids can be one or more aliphatic, mono-functional organic acids or salts thereof as described herein, particularly one or more aliphatic, mono-functional, saturated or unsaturated organic acids having less than 36 carbon atoms or salts of the organic acids, such as stearic acid or oleic acid. Fatty acids or fatty acid salts are particularly suitable and can be non-volatile and non-migratory. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. As a general guideline, when the melt flow modifier is an organic acid or salt of organic acid, such can be present from about 5 wt % to about 40 wt % based on the extent of neutralization of the acid polymer.

Neutralizing and the HLB agents can be introduced before or after the partially neutralized acid polymer composition is formed. For example, the neutralizing agent can be introduced by melt-processing the acid polymer composition to produce a partially or highly neutralized polymer in the presence of a sufficient amount of a suitable cation, a sufficient amount of a suitable fatty acid or their salts along with the HLB modifier. Alternatively, the neutralizing agent can be introduced by further melt-processing the partially neutralized acid polymer composition to produce a highly neutralized acid polymer in the presence of a sufficient amount of a suitable cation, a sufficient amount of a suitable fatty acid or their salts along with the HLB modifier. Furthermore, the degree of neutralization can vary and can optionally be achieved in a step-wise fashion. For example, a first neutralizing step can be performed before mixing and formation of the polymer composition after which a second neutralizing step can be performed in order to neutralize to the desired degree. Although the acid groups are at least 70% neutralized, even higher neutralization can often be desirable. In one aspect, the highly neutralized acid polymer is at least 95% neutralized, and in some cases the highly neutralized acid polymer is 100% neutralized.

The highly neutralized acid polymer can comprise at least 50 wt % of the polymer composition such as about 60 wt % to about 95 wt %. Most often, the highly neutralized acid polymer can comprise about 65 wt % to about 90 wt % of the polymer composition.

As part of the polymer composition, HLB modifiers can be added to further enhance processing and final properties of the golf ball. HLB modifiers which are sugar esters are particularly useful in connection with the present invention. The sugar ester HLB modifier can be an ester of a fatty acid or salt thereof and a $C_5$ or $C_6$ sugar. Although other fatty acids having from about 10 to about 22 carbons may be suitable, examples can include stearic acid, lauric acid, palmitic acid, oleic acid, salts thereof, and combinations thereof.

Suitable $C_4$, $C_5$, $C_6$, or $C_7$ sugars for use in forming the sugar esters can include erythrose, threose, arabinose, ribose, ribulose, xylose, xylulose, lyxose, allose, altrose, fructose, galactose, glucose, gulose, idose, mannitose, sorbitose, talose, tagatose and sedoheptulose, sucrose esters of fatty acids, polyoxyethylene derivatives thereof, and combinations thereof. Suitable sugars can have at least one hydroxyl group and can be hydrogenated or non-hydrogenated. Mannose has the formula (I)

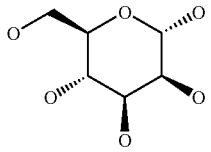

and arabinose has the formula (II)

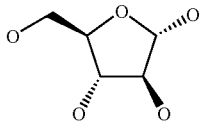

and can be useful in connection with the present invention. However, in particular, sorbitose can be used as the sugar such that the resulting ester of the fatty acid is (III)

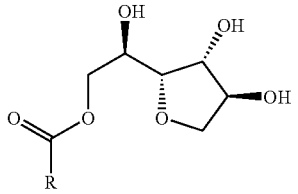

where R is a fatty acid group derived from the fatty acid (e.g. those listed previously). Sorbitan oleates, including monooleate, dioleate, trioleate and sesquioleate can be used. Furthermore, sugar esters such as sorbitan esters of laurate, palmate, stearate fatty acids, and polyoxyethylene derivatives of these acids can be used. Non-limiting examples of commercially available sugar esters include Tween 20, SPAN 60, SPAN 80, SPAN 85, Myrj 59, Pluronic L35, Pluronic F38, Pluronic F88, Alkamuls SMO, Capmul O, Glycomul O, Arlacel 80, Emsorb 2500 and S-Maz 80.

The ester of the fatty acid can include polyoxyethylene groups. For example, the C5 or C6 sugar can be a polyoxyethylene derivative. In one example, the polyoxyethylene can be sorbitose such that the ester of the fatty acid is:

(IV)

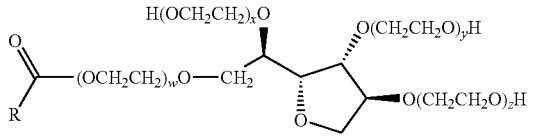

where R is a fatty acid group derived from the fatty acid and w, x, y and z are integers. Although w, x, y, and z can vary, most commercially available materials have a w+x+y+z sum of 20. Non-limiting examples of commercially available polyoxyethylene sugar esters include polysorbates such as POE (20) sorbitan monooleate, POE (20) sorbitan sesquioleate, POE (20) sorbitan laurate, POE (20) sorbitan palmate, Polysorbate 80, Tween 20, Tween 21, Tween 60K, Tween 65, Tween 65K, Tween 60, Tween 80, Tween 81, Tween 85, Emsorb 6900, Liposorb O-20, and T-Maz 80.

Regardless of the specific sugar ester HLB modifier chosen, the HLB modifier can have a HLB from about 3 to about 35, preferably 4 to 20 and more preferably 4 to 15. Specific amounts of HLB modifier can vary somewhat depending on the particular sugar ester chosen. However, as a general guideline the concentrations can be relatively high, e.g. 15 wt % to about 40 wt %. In particular, it has been found that a sugar ester HLB modifier content greater than 15 wt % and up to about 40 wt % of the polymer composition can be particularly beneficial. These substantially higher levels of sugar ester HLB modifier content are believed to provide differing and improved melt flow characteristics that are beneficial and novel to the golf ball layers of the invention. In one specific embodiment, the sugar ester HLB modifier is present from about 20 wt % to about 35 wt % of the polymer composition.

Although plasticizers may or may not be present as well, e.g., fatty acids and/or polyhydric alcohols, some embodiments are devoid of these other plasticizers, and other embodiments are co-formulated with these or other types of plasticizers.

The HNP-containing compositions of the present invention can also include one or more other additives. Suitable additives include, but are not limited to, chemical blowing and foaming agents, optical brighteners, coloring agents, fluorescent agents, whitening agents, UV absorbers, light stabilizers, defoaming agents, processing aids, mica, talc, nano-fillers, antioxidants, stabilizers, softening agents, fragrance components, plasticizers, impact modifiers, $TiO_2$, acid copolymer wax, surfactants, and fillers, such as zinc oxide, tin oxide, barium sulfate, zinc sulfate, calcium oxide, calcium carbonate, zinc carbonate, barium carbonate, clay, tungsten, tungsten carbide, silica, lead silicate, regrind (recycled material), and mixtures thereof. Suitable additives are more fully described in, for example, U.S. Pat. No. 7,041,721, the disclosure of which is hereby incorporated herein by reference. Other optional additives can include fibers, flakes, particulates, microspheres, pre-expanded beads of glass, ceramic, metal or polymer, and the like which may be optionally foamed. Depending on the additive, such additives can be present in an amount of from 0 wt % to 60 wt %, based on the total weight of the composition.

The cover layer, or any layer of a multiple layer cover, can be formed of suitable polymers such as the polymer composition described herein, polyurethanes, or polyureas. Most often, the outer cover layer comprises a light stable polyurethane or polyurea, and an inner cover layer or core layer will include the HNP materials described herein.

As briefly summarized above, golf balls of the present invention can be formed having a variety of internal configurations. For example, golf balls of the present invention can be wound, one-piece, two-piece, or multi-layer balls, wherein at least one layer includes the polymer composition described herein containing the HLB modifiers. In golf balls having two or more layers which comprise a highly neutralized polymer, the highly neutralized polymer composition of one layer may be the same or a different highly neutralized polymer composition as another layer. The layer(s) comprising the highly neutralized polymer composition can be any one or more of a core layer, an intermediate layer, or a cover layer. Although note required, the core can often include a center and an outer core layer. Similarly, the cover layer can be a double layer cover having an inner cover layer and an outer cover layer. The outer core layer or the inner cover layer would both be considered intermediate layers. Intermediate layers can also optionally include thin moisture barrier layers, coating layers, adhesive layers, etc.

Typically, golf balls of the present invention are multi-layer balls having a compression molded rubber core, at least one injection or compression molded intermediate layer which comprises a highly neutralized polymer composition, and a cast or reaction injection molded polyurethane or polyurea outer cover layer. The rubber core composition can comprise a base rubber, a crosslinking agent, a filler, and a co-crosslinking or initiator agent. Typical base rubber materials include natural and synthetic rubbers, including, but not limited to, polybutadiene and styrene-butadiene. The crosslinking agent typically includes a metal salt, such as a zinc salt or magnesium salt, of an acid having from 3 to 8 carbon atoms, such as (meth)acrylic acid. The initiator agent can be any known polymerization initiator which decomposes during the cure cycle, including, but not limited to, dicumyl peroxide, 1,1-di-(t-butylperoxy) 3,3,5-trimethyl cyclohexane, a-a bis-(t-butylperoxy)diisopropylbenzene, 2,5-dimethyl-2,5 di-(t-butylperoxy)hexane or di-t-butyl peroxide, and mixtures thereof. Suitable types and amounts of base rubber, crosslinking agent, filler, co-crosslinking agent, and initiator agent are more fully described in, for example, U.S. Pat. No. 6,939,907, the disclosure of which is hereby incorporated herein by reference and also describes various ball constructions and materials that can be used in golf ball core, intermediate, and cover layers of the present invention.

Various properties of the golf ball can dramatically affect performance. These properties can be a result of the particular materials and golf ball design chosen. Accordingly, the present invention can have a center having a diameter of from 1.00 inches to 1.63 inches and an Atti compression of from 40 to 90. Most often, the center has a surface hardness of from 20 Shore D to 70 Shore D, preferably 30 Shore D to 55 Shore D. When present, the intermediate layer can generally have a material hardness of from 30 Shore D to 80 Shore D, preferably 50 to 70 Shore D. Although other dimensions can be used, the intermediate layer typically has a thickness of from 0.020 inches to 0.090 inches, more often from 0.010 inches to 0.060 inches. The outer cover layer typically has a thickness of from 0.015 inches to 0.060 inches, more often from 0.020 inches to 0.040 inches.

Golf balls of the present invention generally also have a coefficient of restitution ("COR") of at least 0.790, such as at least 0.800, in some cases at least 0.805, and even other cases at least 0.810. Furthermore, an Atti compression of from 75 to 110, such as from 90 to 105, can be particularly suitable. COR is defined as the ratio of the rebound velocity to the inbound velocity when balls are fired into a rigid plate. In determining COR, the inbound velocity is understood to be 125 ft/s.

The polymer compositions of the present invention typically have a flexural modulus of from 3,000 psi to 150,000 psi, such as from 5,000 psi to 100,000 psi, in some cases from 10,000 psi to 90,000 psi, and in other cases from 15,000 psi to 80,000 psi. The material hardness of the HNP-containing compositions is generally from 30 Shore D to 80 Shore D, more often from 40 Shore D to 75 Shore D, and in some cases from 45 Shore D to 70 Shore D. The notched izod impact strength of the polymer compositions of the present invention is generally at least 2 ft-lb/in, as measured at 23° C. according to ASTM D256.

As a guideline, in order to be processible, the HNP-containing composition can have a melt flow index of at least 0.5 g/10 min at 190° C. (ASTM D1238). More particularly, the melt flow index of the HNP-containing composition can be from 0.5 g/10 min to 10.0 g/10 min, such as from 1.0 g/10 min to 5.0 g/10 min, and in some cases from 1.0 g/10 min to 4.0 g/10 min.

The present invention is not limited by any particular method for making the polymer composition. In one embodiment, the composition is prepared by an extrusion process utilizing a melt extruder, such as a single or twin screw extruder. In a typical extruder process, the acid polymer(s), HLB modifier(s), and optional additives are fed, either simultaneously or separately, into the extruder and melt blended at a temperature typically within the range of from 200° C. to 300° C. The cation source is concurrently or subsequently added to neutralize the acid polymer(s) to a desired level. The acid polymer(s) may be partially neutralized prior to contact with the cation source. In another embodiment, the composition is prepared by heating and reacting the acid polymer(s) and HLB modifiers at a temperature above the melting point of the polymeric components. In still another embodiment, an unneutralized ionomer can be blended with the ionic plasticizer and then neutralized. Optionally, a partially neutralized ionomer can be mixed with the plasticizer and subsequently additional cation added to further neutralize the ionomer.

Similarly, the present invention is not limited by any particular process for forming the golf ball layer(s). It should be understood that the layer(s) can be formed by any suitable technique including, but not limited to, injection molding, compression molding, casting, and reaction injection molding. For example, the compositions disclosed in Tables 1 and 2 may be used as an outer core layer by compression or injection molding those compositions over a solid crosslinked rubber base center known in the golf ball art.

TABLE 1

Golf ball outer core layer compositions based on a highly neutralized 19% methacrylic acid polymer with a HLB modifier like Tween ® 20

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Nucrel ® 2940[1] | 100 | 100 | 100 | 100 | 100 | 100 | 100 | 100 |
| Na (OH) | 7 | 7 | 7 | 7 | 8.8 | 8.8 | 8.8 | 8.8 |
| Tween ® 20[2] | 0 | 15 | 30 | 40 | 0 | 15 | 30 | 40 |
| Zinc Stearate | 40 | 25 | 10 | 0 | 60 | 45 | 30 | 20 |

[1]NUCREL ® 2940 is a copolymer of ethylene and 19% methacrylic acid from DuPont
[2]TWEEN ® 20 is a sorbitan stearate from Promega
Note:
examples 1-4 were 80% neutralized and examples 5-8 were 100% neutralized

TABLE 2

Golf ball outer core layer compositions based on a highly neutralized 15% methacrylic acid polymer with a HLB modifier like TWEEN ® 20

| | Ex. 9 | Ex. 10 | Ex. 11 | Ex. 12 | Ex. 13 | Ex. 14 | Ex. 15 | Ex. 16 |
|---|---|---|---|---|---|---|---|---|
| Nucrel ® 2940[1] | 100 | 100 | 100 | 100 | 100 | 100 | 100 | 100 |
| Na (OH) | 5.6 | 5.6 | 5.6 | 5.6 | 6.7 | 6.7 | 6.7 | 6.7 |

TABLE 2-continued

Golf ball outer core layer compositions based on a highly neutralized 15% methacrylic acid polymer with a HLB modifier like TWEEN ® 20

| | Ex. 9 | Ex. 10 | Ex. 11 | Ex. 12 | Ex. 13 | Ex. 14 | Ex. 15 | Ex. 16 |
|---|---|---|---|---|---|---|---|---|
| Tween ® 20[2] | 0 | 15 | 30 | 40 | 0 | 15 | 30 | 40 |
| Zinc Stearate | 40 | 25 | 10 | 0 | 60 | 45 | 30 | 20 |

[1]NUCREL ® 960 is a copolymer of ethylene and 15% methacrylic acid from DuPont
[2]TWEEN ® 20 is a sorbitan stearate from Promega
Note:
examples 9-12 were 80% neutralized and examples 13-16 were 100% neutralized The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A golf ball comprising a core and a cover layer surrounding the core, wherein at least one of the core or the cover layer comprises a polymer composition of a highly neutralized acid polymer and a sugar ester HLB modifier such that the sugar ester HLB modifier is present from about 15 wt % to about 40 wt % of the polymer composition;

wherein the sugar ester is an ester of a fatty acid or salt thereof and a $C_5$ or $C_6$ sugar selected from the group consisting of arabinose, ribose, ribulose, xylose, xylulose, lyxose, allose, altrose, fructose, galactose, glucose, gulose, idose, mannitose, talose, tagatose and sedoheptulose, sucrose esters of fatty acids, polyoxyethylene derivatives thereof, and combinations thereof.

2. The golf ball of claim 1, wherein the highly neutralized acid polymer is a copolymer of a $C_3$ to $C_8$ $\alpha,\beta$-ethylenically unsaturated carboxylic acid and a $C_2$ to $C_6$ $\alpha$-olefin.

3. The golf ball of claim 1, wherein the highly neutralized acid polymer further includes a softening monomer.

4. The golf ball of claim 1, wherein the highly neutralized acid polymer is at least 95% neutralized.

5. The golf ball of claim 1, wherein the highly neutralized acid polymer is 100% neutralized.

6. The golf ball of claim 1, wherein the highly neutralized acid polymer is neutralized with a metal cation and a fatty acid or fatty acid salt present in amounts sufficient to neutralize the acid polymer by 100%.

7. The golf ball of claim 1, wherein the cover layer is a double cover having an inner cover layer and an outer cover layer.

8. The golf ball of claim 1, wherein the fatty acid is selected from the group consisting of stearic acid, lauric acid, palmitic acid, oleic acid, salts thereof, and combinations thereof.

9. The golf ball of claim 1, wherein the polymer composition has a melt flow index from about 0.5 to about 5.0.

10. The golf ball of claim 1, wherein the cover layer comprises a thermoplastic or thermoset polyurethane or polyurea.

11. The golf ball of claim 1, wherein the $C_5$ or $C_6$ sugar is a polyoxyethylene derivative.

12. The golf ball of claim 1, wherein the sugar ester HLB modifier is present from about 20 wt % to about 35 wt % of the polymer composition.

13. The golf ball of claim 1, wherein the sugar ester HLB modifier has a HLB from about 3 to about 35.

14. The golf ball of claim 1, wherein the core comprises a center and an outer core layer.

15. The golf ball of claim 14, wherein the outer core layer comprises the polymer composition.

16. The golf ball of claim 15, wherein the inner cover layer includes the polymer composition.

* * * * *